US005568920A

United States Patent [19]

Moll

[11] Patent Number: 5,568,920

[45] Date of Patent: Oct. 29, 1996

[54] TURNING DEVICE FOR TRANSPORT APPARATUS

[76] Inventor: Richard J. Moll, 415 Constance Dr., Warminster, Pa. 18974

[21] Appl. No.: 588,268

[22] Filed: Jan. 18, 1996

[51] Int. Cl.[6] ..... B65H 5/00

[52] U.S. Cl. ..... 271/225; 271/184; 271/250; 271/253

[58] Field of Search ..... 271/184, 185, 271/225, 250, 252, 253, 254

[56] References Cited

U.S. PATENT DOCUMENTS 5,056,772 10/1991 Kellum, III ..... 271/225 X 5,114,137 5/1992 Olson ..... 271/184 X

*Primary Examiner*—H. Grant Skaggs
*Assistant Examiner*—Boris Milef
*Attorney, Agent, or Firm*—Zachary T. Wobensmith, III

[57] ABSTRACT

A turning device for transport apparatus which receives product such as paper folders, stops the product and rotates the product 90 degrees with the product then transported in the same direction by the apparatus for further operations as required.

5 Claims, 3 Drawing Sheets

TURNING DEVICE FOR TRANSPORT APPARATUS

BACKGROUND OF THE INVENTION

1. Field of the Invention

This invention relates to a turning device for use with transport apparatus of the type that changes the orientation of products by 90 degrees during their travel.

2. Description of the Prior Art

When processing products such as folded paper jackets it is often desirable to be able to change the orientation of the product by 90 degrees, for further operations on the product in the same or other equipment, such as applying pocket folds or stacking. This orientation change, for example with endless belt transport of paper folders, is usually accomplished by depositing the product on intersecting belts that are perpendicular to the direction of travel of the original transport apparatus. This method requires additional transport apparatus with a bed, frame, endless belts, driving motor and controls which is expensive, and requires more space, and coordination between the intersecting transport apparatus and is generally not satisfactory.

The turning device of the invention is adaptable to virtually all types of belt transport apparatus, does not require significant additional equipment and provides many positive advantages over the prior art.

SUMMARY OF THE INVENTION

It has now been found that a relatively simple device is available that is attached to a transport apparatus, which stops products and changes their orientation by 90 degrees, after which they continue to travel in the same direction.

The principal object of the invention is to provide a turning device for transport apparatus that changes the orientation of the product by 90 degrees.

A further object of the invention is to provide a turning device of the character aforesaid that is useful with a variety of transport apparatus.

A further object of the invention is provide a turning device of the character aforesaid that is vertically adjustable to accommodate different stock thicknesses.

A further object of the invention is to provide a turning device of the character aforesaid that is easy to install and to remove.

A further object of the invention is to provide a turning device that is inexpensive to construct, but is durable and long-lasting in operation.

A further object of the invention is to provide a turning device that is fast and positive in operation.

Other objects and advantageous features of the invention will be apparent from the description and the claims.

DESCRIPTION OF THE DRAWINGS

The nature and characteristic features of the invention will be more readily understood from the following description taken in connection with the accompanying drawings forming part hereof in which.

It should of course be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment but also technical equivalents which operate and function in substantially the same way to bring about the same result.

Figure 1:
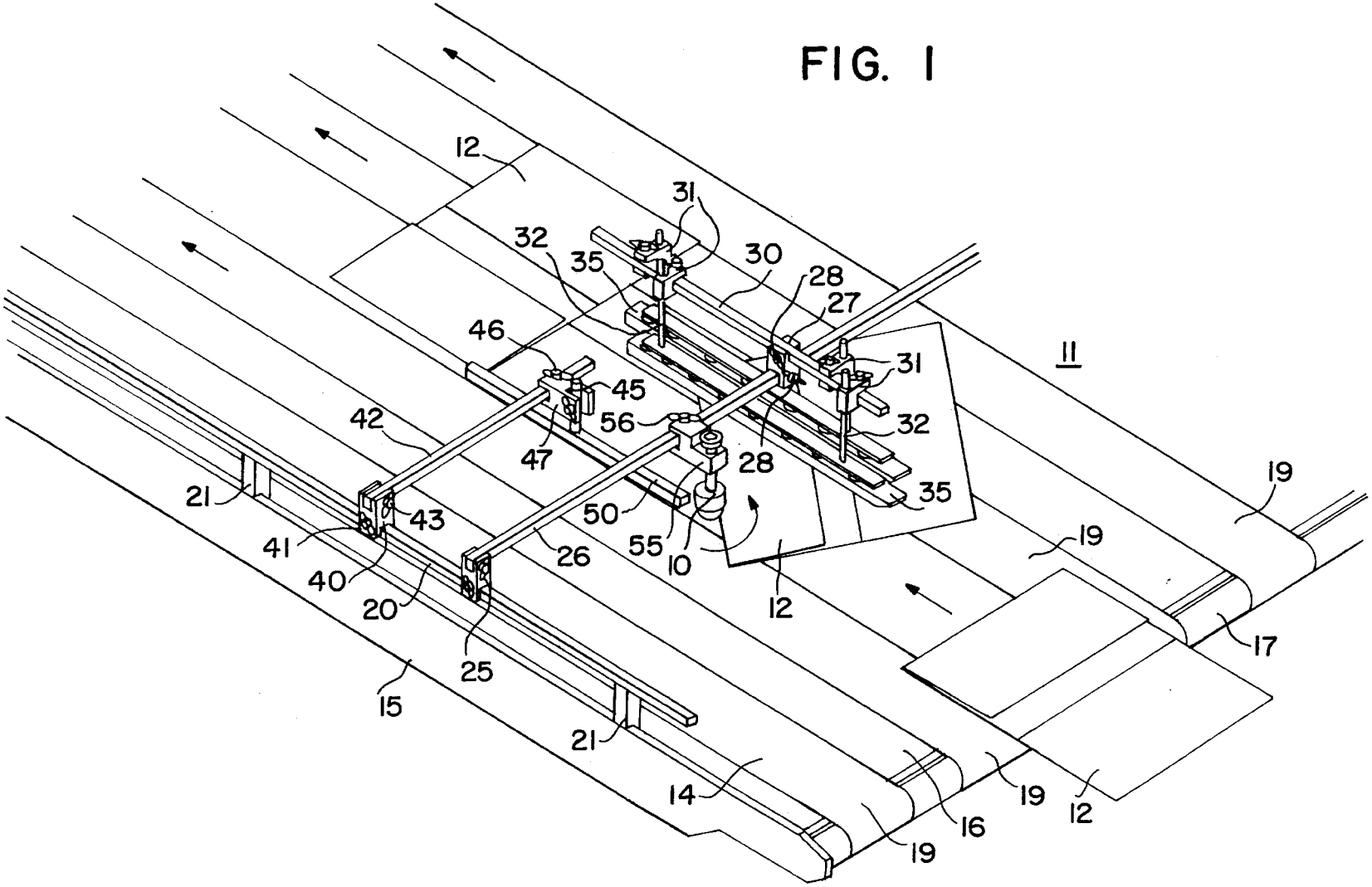
FIG. 1 is a perspective view of the turning device of the invention installed on a transport apparatus.
Figure 3:
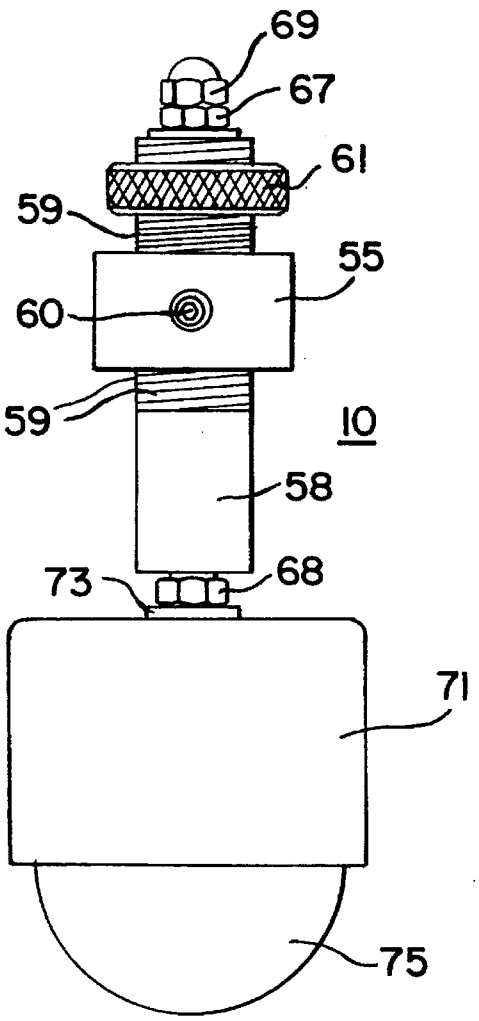
FIG. 3 is a front view of the turning device of the invention.
Figure 2:
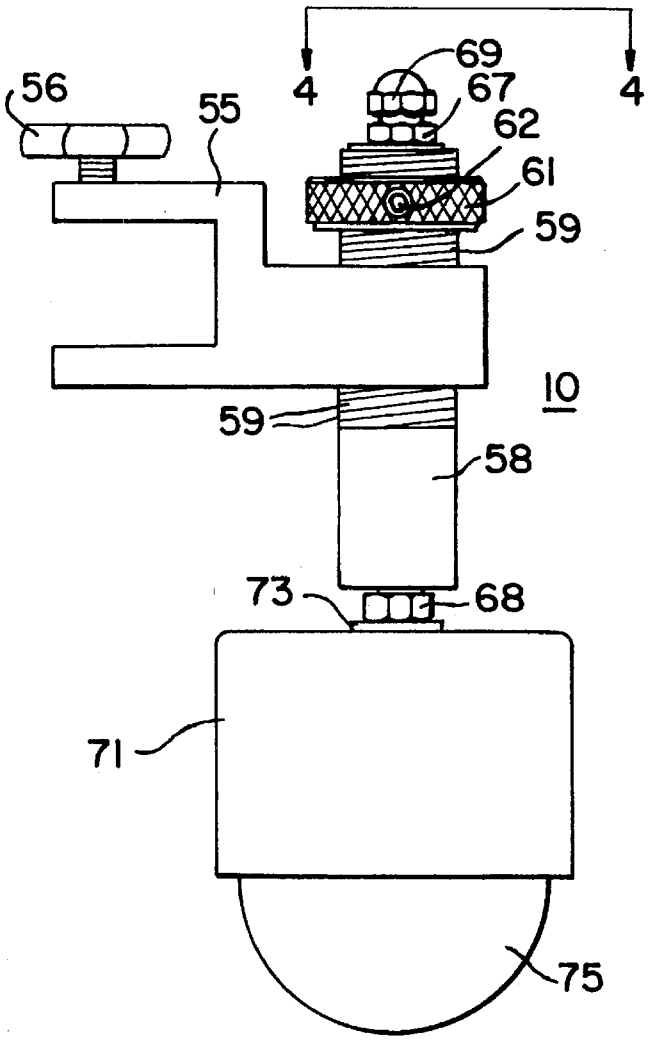
FIG. 2 is a left side view of the turning device of the invention.
Figure 4:
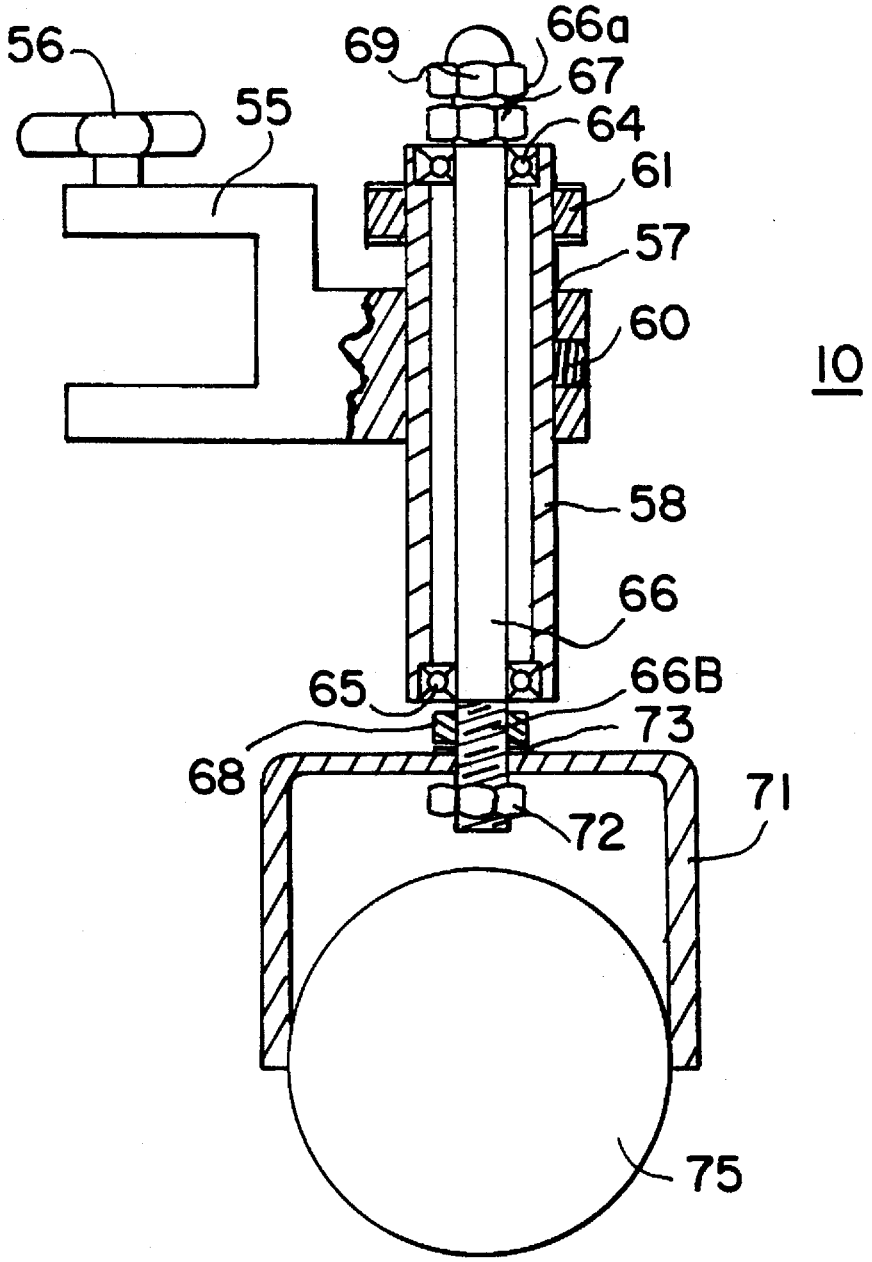
FIG. 4 is a vertical sectional view taken approximately on the line 4—4 of FIG. 2.

Referring now more particularly to FIG. 1 of the drawings, one embodiment of the turning device 10 is therein illustrated in operation on a transport apparatus 11. The transport apparatus is typical of such apparatus which transport or convey various products such as folded paper jackets 12. The apparatus 11 includes a frame (not shown), having a bed 14, and at least one side rail 15. The bed 14 includes a bed plate 16 which is smooth and preferably of metal, with a rotatable roller 17 extending from the rail 15 across the front of the apparatus.

A plurality of endless belts 19 are provided, of well known type, engaged with roller 17 and extending along bed 14 for transporting or conveying jackets 12. The side rail 15 has a track bar 20 engaged therewith by blocks 21 and extends therealong. A bracket 25 is attached to track bar 20 and carries one end of a support bar 26, which extends transversely across the bed 14, and is attached to a track bar (not shown) on the other side of bed 14.

The support bar 26 has a bracket 27 attached thereto and movable therealong, with a thumbscrew 28 to secure it at selected locations on bar 26. The bracket 27 has a top drive bar 30 attached thereto, with a thumbscrew 28 therein to restrain drive bar 30 at desired locations. The top drive bar 30 has brackets 31 engaged therewith, with rods 32 attached thereto and to marble guide plates 35 of well-known type, which have marbles (not shown) which engage the folders 12 and restrain them from vertical movement but permit passage underneath the plates 35. The track bar 20 has a bracket 40 engaged therewith, with a thumbscrew 41 to restrain its movement. The bracket 40 has a guide support bar 42 engaged therewith, which is restrained thereon by thumbscrew 43, and which extends across the bed 14. An additional bracket 45 is engaged with bar 42, with a thumbscrew 46 therein for adjustment, with a rod 47 engaged therewith and with a guide bar 50 which extends in the direction of travel of belts 19. The guide bar 50 guides folders 12 after rotation to be described.

The support bar 26 also carries a mounting clamp 55 engaged with the turning device 10 which includes bar 26, which has a thumbscrew 36 for positioning of clamp 55 on bar 26. The clamp 55 has a vertical opening 57, which contains a tube 58, which has a plurality of threads 59 therealong, and is retained in opening 57 by a nylon tipped set screw 60. The tube 58 has an adjustment knob 61 for vertical adjustment of tube 58 to accommodate different thicknesses of stock, which knob is engaged with the threads 59, and a set screw 62 is provided in knob 61 to lock it to threads 59. The tube 58 has upper and lower ball bearings 64 and 65 therein, which carry a swivel shaft 66, which has threads 66 A and 66B thereon, and which is retained in the tube 58 by upper and lower hex nuts 67 and 68, with an acorn nut 69 on the top.

A bump housing 71 is provided, retained on the swivel shaft 66 by a hex nut 72 with a flat washer 73 therebetween.

The housing 71 is of circular configuration, preferably formed of metal, and has a bump ball 75 therein, which is press-fitted into the housing 71. The bump ball 75 is round, can be formed of any suitable synthetic plastic, preferably formed of neoprene, and located at a predetermined distance from bed plate 16 to engage jackets 12 for rotation to be described.

The mode of operation will now be pointed out. Jackets 12 are fed onto belts 19 from other sources to be conveyed on transport apparatus 11. The bump ball 75 is adjusted above bed plate 16 to accommodate the thickness of the stock to be turned. The jackets 12, one at a time engage bump ball 75 of turning device 10, and guide plates 35. Each jacket 12 is stopped when it hits bump ball 75, and the forward motion of belt 19 causes the jacket 12 to rotate bump ball 75 and itself thereabout until it strikes guide bar 40, which engages the jacket 12 to prevent further rotation greater than 90 degrees and then bar 40 guides jacket 12 which is again transported by belts 19 in the original direction of travel to its final destination.

It will thus be seen that a turning device for transport apparatus has been provided with which the objects of the invention are attained.

I claim:

1. A turning device for turning products being conveyed on endless belts on a flatbed transport apparatus at at least a 90 degree angle from their original orientation while being transported and which are then again transported in their original direction, which comprises a track bar attached to at least one side of said bed, a support bar means attached to said track bar and which extends transversely across said bed, bracket means attached to said support bar means and positionable at selected locations thereacross:

marble guide bar means attached to said bracket means and positionable to engage said products which pass between it and said bed;

mounting clamp means attached to said support bar means and positionable thereacross;

a vertical hollow tube engaged with said mounting clamp means;

upper and lower bearings mounted in said tube;

a swivel shaft carried in said bearings in said tube;

a bump housing carried by said swivel shaft;

a bump ball in said housing for engagement with said product for rotation thereabout;

a guide support bar mounted to said track bar and extending transversely across said bed;

a bracket engaged with said guide support bar and positionable thereacross;

a rod engaged with said guide support bar bracket and;

a guidebar engaged with said rod and which is oriented in the direction of conveyance of said product to receive and guide said product after it is rotated by said bump ball.

2. A turning device as defined in claim 1 in which;

said bump ball is round and formed of synthetic plastic.

3. A turning device as defined in claim 1 in which;

means are provided for varying the vertical position of said tube in said mounting clamp means, to vary the height of the bump ball above the bed.

4. A turning device as defined in claim 1 in which;

said marble guide bar means includes means for vertical and horizontal positioning thereof.

5. A turning device as defined in claim 2 in which;

said synthetic plastic is neoprene.

* * * * *